US007541005B2

(12) United States Patent
Kulkarni et al.

(10) Patent No.: US 7,541,005 B2
(45) Date of Patent: Jun. 2, 2009

(54) CATALYTIC THERMAL BARRIER COATINGS

(75) Inventors: Anand A. Kulkarni, Orlando, FL (US); Christian X. Campbell, Orlando, FL (US); Ramesh Subramanian, Oviedo, FL (US)

(73) Assignee: Siemens Energy Inc., Orlando, FL (US)

( * ) Notice: Subject to any disclaimer, the term of this patent is extended or adjusted under 35 U.S.C. 154(b) by 500 days.

(21) Appl. No.: 11/244,739

(22) Filed: Oct. 6, 2005

(65) Prior Publication Data

US 2006/0245984 A1 Nov. 2, 2006

Related U.S. Application Data

(63) Continuation-in-part of application No. 09/963,283, filed on Sep. 26, 2001, now abandoned.

(51) Int. Cl.
*B01D 50/00* (2006.01)

(52) U.S. Cl. ..... 422/177

(58) Field of Classification Search ..... 422/171, 422/177, 180, 211, 222, 190; 60/723, 777; 428/335, 472, 623

See application file for complete search history.

(56) References Cited

U.S. PATENT DOCUMENTS

| | | | |
|---|---|---|---|
| 3,972,837 | A | 8/1976 | Acres et al. |
| 4,086,082 | A | 4/1978 | Mahalla |
| 4,115,462 | A | 9/1978 | Thelen et al. |
| 4,142,864 | A | 3/1979 | Rosynsky et al. |
| 4,147,763 | A | 4/1979 | McKinzie et al. |
| 4,220,560 | A | 9/1980 | Anquetil et al. |
| 4,279,864 | A | 7/1981 | Nara et al. |
| 4,300,956 | A | 11/1981 | Rosenberger et al. |
| 4,340,505 | A | 7/1982 | Dolan |
| 4,343,074 | A | 8/1982 | Bailey et al. |
| 4,395,579 | A | 7/1983 | Germaine et al. |
| 4,456,703 | A | 6/1984 | Aldridge |
| 4,537,867 | A | 8/1985 | Fiato et al. |
| 4,603,547 | A | 8/1986 | Pfefferle et al. |
| 4,604,375 | A | 8/1986 | Soled et al. |
| 4,609,563 | A | 9/1986 | Shimrock et al. |
| 4,711,009 | A | 12/1987 | Cornelison et al. |
| 4,870,824 | A | 10/1989 | Young et al. |
| 4,959,494 | A | 9/1990 | Felthouse |
| 5,043,311 | A | 8/1991 | Engler et al. |

(Continued)

OTHER PUBLICATIONS

Groppi, Gianpiero et al., BaFexAl(12-x)O19 System for High-Temperature Catalytic Combustion; Physico-Chemical Characterization and Catalytic Activity. Journal of Catalysis, vol. 168, 1977, pp. 95-103.*

*Primary Examiner*—Tom Duong

(57) ABSTRACT

A catalyst element (30) for high temperature applications such as a gas turbine engine. The catalyst element includes a metal substrate such as a tube (32) having a layer of ceramic thermal barrier coating material (34) disposed on the substrate for thermally insulating the metal substrate from a high temperature fuel/air mixture. The ceramic thermal barrier coating material is formed of a crystal structure populated with base elements but with selected sites of the crystal structure being populated by substitute ions selected to allow the ceramic thermal barrier coating material to catalytically react the fuel-air mixture at a higher rate than would the base compound without the ionic substitutions. Precious metal crystallites may be disposed within the crystal structure to allow the ceramic thermal barrier coating material to catalytically react the fuel-air mixture at a lower light-off temperature than would the ceramic thermal barrier coating material without the precious metal crystallites.

17 Claims, 1 Drawing Sheet

U.S. PATENT DOCUMENTS 5,047,381 A 9/1991 Beebe
5,137,862 A 8/1992 Mackrodt et al.
5,202,303 A 4/1993 Retallick et al.
5,263,998 A 11/1993 Mackrodt et al.
5,293,743 A 3/1994 Usleman et al.
5,318,757 A 6/1994 Abe et al.
5,440,872 A 8/1995 Pfefferle
5,492,038 A 2/1996 Chylinski et al.
5,518,697 A 5/1996 Dalla Betta et al.
5,551,239 A 9/1996 Feeley et al.
5,555,621 A 9/1996 Tanabe et al.
5,562,998 A 10/1996 Strangman
5,612,277 A 3/1997 Harkonen et al.
5,787,584 A 8/1998 Shea et al.
5,826,429 A 10/1998 Beebe et al.
5,840,434 A 11/1998 Kojima et al.
5,866,079 A 2/1999 Machida et al.
5,876,681 A 3/1999 Barthe et al.
5,885,917 A 3/1999 Ohdan et al.
5,914,189 A 6/1999 Hasz et al.
5,925,590 A 7/1999 White et al.
5,985,220 A 11/1999 Hughes
6,006,516 A 12/1999 Voss et al.
6,077,483 A * 6/2000 Locker et al. ..... 422/179
6,086,829 A 7/2000 Shea et al.
6,099,809 A 8/2000 Foster et al.
6,162,530 A 12/2000 Xiao et al.
6,203,927 B1 3/2001 Subramanian et al.
6,231,991 B1 5/2001 Maloney
6,272,863 B1 8/2001 Pfefferle et al.
6,319,614 B1 11/2001 Beele
6,365,281 B1 4/2002 Subramanian et al.
6,492,038 B1 12/2002 Rigney et al.
6,524,996 B1 2/2003 Bender et al.
6,586,115 B2 7/2003 Rigney et al.
6,677,064 B1 * 1/2004 Subramanian ..... 428/702
2001/0014648 A1 8/2001 Hums et al.
2003/0049470 A1 3/2003 Maloney
2003/0103875 A1 6/2003 Campbell et al.
2004/0024071 A1 2/2004 Meier
2004/0082469 A1 4/2004 Gandhi et al.
2004/0127351 A1 7/2004 Basile et al.
2004/0177556 A1 9/2004 Hagemeyer et al.
2004/0191150 A1 9/2004 Yano et al.

* cited by examiner

CATALYTIC THERMAL BARRIER COATINGS

RELATED APPLICATIONS

This application is a continuation-in-part of U.S. patent application Ser. No. 09/963,283 filed on 26 Sep. 2001 now abandoned, which is incorporated by reference herein.

GOVERNMENT INTEREST

This invention was made with United States Government support through Contract Number DOE-DE-FC26-03NT41891 awarded by the Department of Energy, and, in accordance with the terms set forth in that contract, the United States Government may have certain rights in the invention.

FIELD OF THE INVENTION

This invention relates generally to the field of catalytic combustion, and more specifically to catalytic combustion in a gas turbine engine environment.

BACKGROUND OF THE INVENTION

In the operation of a conventional gas turbine engine, intake air from the atmosphere is compressed and heated by a compressor and is caused to flow to a combustor, where fuel is mixed with the compressed air and the mixture is ignited and burned. The heat energy thus released then flows in the combustion gases to the turbine where it is converted into rotary mechanical energy for driving equipment, such as for generating electrical power or for running an industrial process. The combustion gases are then exhausted from the turbine back into the atmosphere. These gases include pollutants such as oxides of nitrogen, carbon monoxide and unburned hydrocarbons. Various schemes have been used to minimize the generation of such pollutants during the combustion process. The use of a combustion catalyst in the combustion zone is known to reduce the generation of these pollutants since catalyst-aided combustion promotes complete combustion of lean premixed fuels and can occur at temperatures well below the temperatures necessary for the production of NOx species. Typical catalysts for a hydrocarbon fuel-oxygen reaction include platinum, palladium, rhodium, iridium, terbium-cerium-thorium, ruthenium, osmium and oxides of chromium, iron, cobalt, lanthanum, nickel, magnesium and copper incorporated in a ceramic matrix.

FIG. 1 illustrates a prior art gas turbine combustor 10 wherein at least a portion of the combustion takes place in a catalytic reactor 12. Such a combustor 10 is known to form a part of a combustion turbine apparatus that may be used to power an electrical generator or a manufacturing process. Compressed air 14 from a compressor (not shown) is mixed with a combustible fuel 16 by a fuel-air mixing device such as fuel injectors 18 at a location upstream of the catalytic reactor 12. Catalytic materials present on surfaces of the catalytic reactor 12 react the fuel-air mixture at temperatures lower than normal ignition temperatures. Known catalyst materials are not active at the compressor discharge supply temperature for certain fuels and engine designs, such as natural gas lean combustion. Accordingly, a preheat burner 20 is provided to preheat the combustion air 14 by combusting a supply of preheat fuel 22 upstream of the main fuel injectors 18. Existing catalytic combustor designs react approximately 10-15% of the fuel on the catalyst surface, with the remaining combustion occurring downstream in the burnout region 24.

Increasing the percentage of the combustion on the catalyst surface will decrease the amount of combustion occurring in the flame, thus decreasing the overall emission of oxides of nitrogen. However, increasing the amount of combustion on the catalyst surface will also increase the temperature of both the catalyst and the catalyst substrate. One of the limitations to increasing the amount of combustion in the catalytic reactor 12 is the operating temperature limit of the underlying metal substrate material.

The operating environment of a gas turbine is very hostile to catalytic reactor materials, and is becoming even more hostile as the demand for increased efficiency continues to drive firing temperatures upward. Ceramic substrates used for catalytic reactor beds are prone to failure due to thermal and mechanical shock damage. Furthermore, ceramic substrates are difficult to fabricate into complex shapes that may be desired for catalyst elements. Metal substrates have been used with some success with current generation precious metal catalysts at temperatures up to about 800° C. Such catalytic reactors are produced by applying a ceramic wash-coat and catalyst directly to the surface of a high temperature metal alloy. In one embodiment, the catalytic reactor 12 of FIG. 1 is formed as a plurality of metal tubes. The outside surfaces of the tubes are coated with a ceramic wash-coat and a precious metal catalyst. The fuel-air mixture is combusted at the catalyst surface, thereby heating the metal substrate. The substrate is cooled by passing an uncombusted fuel-air mixture through the inside of the tube.

BRIEF DESCRIPTION OF THE DRAWINGS

The invention is explained in following description in view of the drawings that show.

DETAILED DESCRIPTION OF THE INVENTION

Traditional catalytic systems incorporate an active precious metal catalyst such as palladium on a $\gamma$-$Al_2O_3$ wash-coat. The present inventors have found such systems to exhibit poor phase stability, surface area loss, and rapid surface diffusion causing catalyst agglomeration at the very high temperatures desired for modern gas turbine engine designs. For example, the $\gamma$-$Al_2O_3$ phase having a specific surface area (SSA) value of 125-250 $m^2/g$ transforms to either $\theta$ or $\delta$ phase with an SSA value of 18-30 $m^2/g$ at 450° C., which then transforms to $\alpha$ phase with an SSA value of 5 $m^2/g$ between 900-1100° C. To solve these problems, the present inventors have innovatively modified ceramic thermal barrier coating (TBC) materials that are known to exhibit acceptable high temperature insulating characteristics with ionic substitutions that serve to improve the catalytic activity of the materials. In certain embodiments, the inventors have also incorporated precious metal crystallites into the ceramic matrix in order to provide low light-off temperature capability for the materials.

Figure 1:
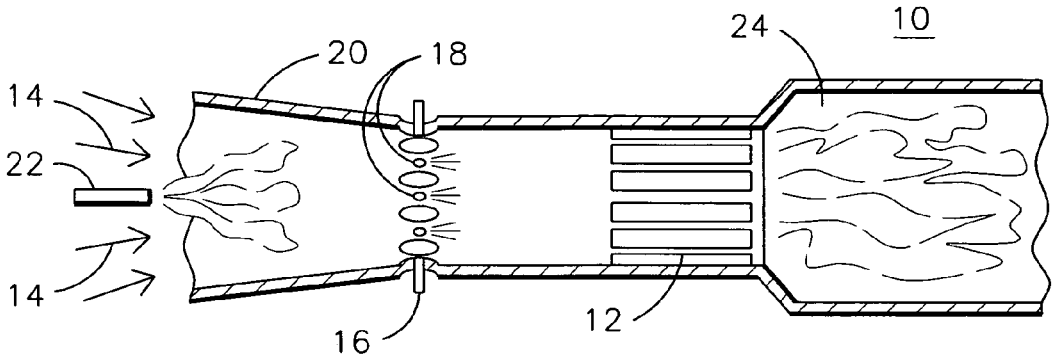
FIG. 1 PRIOR ART
FIG. 1 is a partial schematic illustration of a prior art catalytic combustor for a gas turbine engine.
Figure 2:
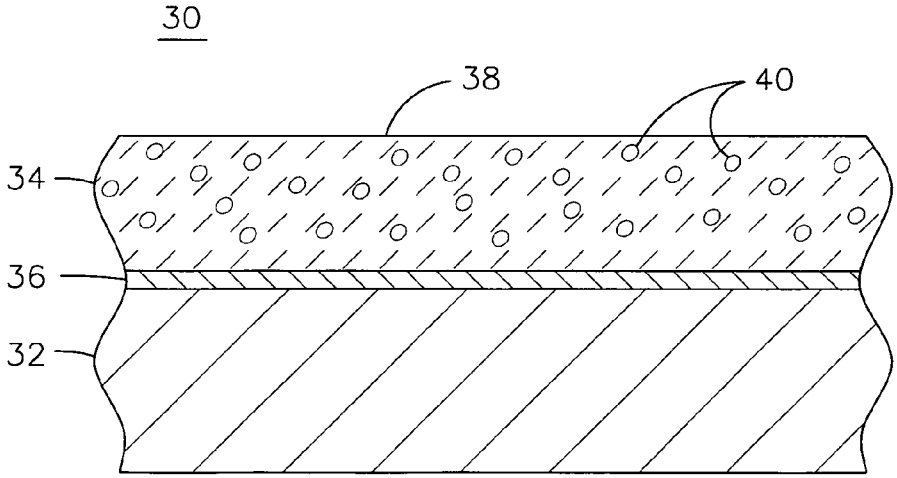
FIG. 2 is a partial cross-sectional view of a catalyst element including a metal tube coated by a catalytic ceramic thermal barrier coating material.

The application of a catalytic material to a ceramic thermal barrier coating on a metal substrate is illustrated in FIG. 2 and described below. FIG. 2 is a partial cross-sectional view of a catalyst element 30 including a metal alloy substrate formed as a thin-walled tube 32. While the tube construction is described herein, one skilled in the art may appreciate that other configurations may be most appropriate for certain applications. Such other configurations may include a flat plate, a foil, or a corrugated structure, for example. The material of construction of the substrate is preferably a high temperature alloy, and may be, for example, stainless steel or a nickel or cobalt based superalloy material. The substrate may be formed to have any desired thickness and shape, for example a thin sheet, and in one embodiment is a 3/16-inch diameter, 0.010-inch thick tube.

A layer of a ceramic thermal barrier coating material 34 is applied over the substrate, for example on the outside surface of the tube 32. A substrate for a catalyst should exhibit a large surface area for maximizing the contact between the catalyst and the fuel-air mixture passing over the substrate surface. Typical ceramic wash-coats used as catalyst substrates possess a specific surface area (SSA) of approximately 18-30 $m^2/g$. A plasma spray process may be used to deposit the thermal barrier coating 34 as a layered structure with surface connected porosity wherein the pore surface area is purposefully maximized to provide an effective SSA value of greater than 30 $m^2/g$ in order to optimize surface catalytic activity. In order to maximize its exposed surface area, thermal barrier coating material 34 may be deposited onto the metal tube 32 by a vapor deposition process in order to produce a columnar-grained microstructure having a plurality of closely spaced columns of material. Such known vapor deposition processes include electron beam physical vapor deposition (EB-PVD), chemical vapor deposition (CVD), electrostatic spray assisted vapor deposition (ESAVD) and electron beam directed vapor deposition (EB DVD). The deposition process parameters may be controlled to optimize the resulting surface area. The columnar-grained structure is known in the art to provide a significant amount of open porosity on the exposed surface of the thermal barrier coating. An idealized EB-TBC columnar-grained thermal barrier coating structure may have an SSA of greater than 30 $m^2/g$, such as between 30-50 $m^2/g$, or between 30-150 $m^2/g$, or between 50-150 $m^2/g$, or between 100-150 $m^2/g$ in various embodiments. In one embodiment the structure may have columns of approximately 10 microns diameter and 10 microns height covered with much smaller cones of material of approximately 1 micron diameter and 1 micron height. Although the actual SSA of a thermal barrier coating deposited by EB-PVD has not been empirically measured by the present inventors, it is assumed that the actual usable specific surface area of a controlled EB-PVD coating would exceed that of a ceramic wash coat substrate because the idealized surface area is so large.

The thermal barrier coating 34 may be deposited onto the tube 32 to any desired thickness, in one embodiment to a thickness of about 0.020-inches. A bond coat 36 may be used between the substrate 32 and the thermal barrier coating 34. Common bond coat materials 36 include MCrAlY, where M denotes nickel, cobalt, iron or mixtures thereof, as well as platinum aluminide and platinum enriched MCrAlY. Techniques for applying ceramic thermal barrier coatings over high temperature metal alloys for use in the environment of a gas turbine combustor are well known in the art, so the catalytic element 30 of FIG. 2 is expected to exhibit long life in this application without early mechanical failure. While EB-PVD coating processes are generally considered to be expensive, it is possible to coat a large number of tubes or other substrate forms simultaneously, thereby reducing the per-unit cost of the process. Furthermore, less expensive plasma or thermal spray coating processes, chemical vapor deposition processes, electron beam directed vapor deposition (EB-DVD) or electrostatic assisted vapor deposition (ESAVD) processes may be developed for producing a similar columnar-grained structure or alternative high-SSA surface.

Ceramic material 34 functions as both a thermal barrier coating (TBC) material and as a combustion catalyst for supporting combustion at its exposed surface 38. Precious metal crystallites 40 may be incorporated into the ceramic material 34 to reduce the light-off temperature of the material. Material 34 is formed of a crystal structure populated with base elements that may include:

pyrochlores with the formula $A_2B_2O_7$ where A is selected from the rare earth elements and B is selected from the group of zirconium, hafnium, titanium, niobium and tantalum (for example, $La_2Hf_2O_7$ and $Sm_2Zr_2O_7$);

garnets with the formula $A_3Al_5O_{12}$ where A is a 3+ cation selected from the group of rare earth elements or transition elements; and spinels with the formula $AB_2O_4$ where A is selected from the group of alkaline earth elements and B is selected from the group of aluminum, iron, manganese, cobalt, chrome and nickel.

Pyrochlore embodiments of the present invention include specially doped $A_2B_2O_7$ materials as well as $Y_2O_3$—$ZrO_2$—$TiO_2$. Pyrochlore systems have been successfully used as TBCs, thus demonstrating their high temperature stability, thermal shock resistance and sintering resistance. The pyrochlore oxides have a general composition, $A_2B_2O_7$, where A is a 3+ cation (Al, Y, Ga, Sc or rare earth elements from the group including La, Ce, Pr, Nd, Pm, Sm, Eu, Gd, Th, Dy, Ho, Er, Tm or Yb) and B is a 4+ cation (zirconium, hafnium, titanium, etc.). The activity of these systems can be further improved by substituting part of the A site elements or B site elements with other cations. The modified A site can be represented by the formula $A_{2-x}M_xB_2O_7$ ($0<x<1$), where M can be any (other than A) 3+ rare earth element or 3+ cation smaller than A such as Al, Y, etc.; or M may be a 2+ cation of the group of Ca, Mg, Sr, and Ba for increased activity. The modified B site can be represented by the formula $A_2B_{2-x}M_xO_7$ ($0<x<1$) where M can be a 3+ cation (Al, Sc) or a 5+ cation (Ta or Nb). The other embodiment of the invention in this family is the conventional yttria stabilized zirconia TBC with $TiO_2$ additions. The concentration of the $TiO_2$ may be from greater than 0% to as high as 25 mole %, for example. This system has three advantages: a) it allows for a crystal structure change from fluorite to pyrochlore depending on the composition of the material; b) substitution of the larger $Zr^{4+}$ with a smaller $Ti^{4+}$ remarkably increases its ionic conductivity; and c) the titanium ions are able to hop from $Ti^{4+}$ to $Ti^{3+}$, thus increasing the catalytic activity of the compound.

Garnet ceramics are being considered for high-temperature structural applications for their superior high-temperature mechanical properties, excellent phase/thermal stability up to the melting point (approximately 1970° C.) and high thermal expansion coefficient (low expansion mismatch with metal substrates). Garnets have a general composition of $A_3B_5O_{12}$, where A is a rare earth element (La, Ce, Pr, Nd, Pm, Sm, Eu, Gd, Th, Dy, Ho, Er, Tm, Yb) or yttrium and B is a 3+ cation (Al, Y, Ga, Sc). The catalytic activity of these systems is further improved in the present invention by substituting part of the A site or B site elements with other cations. The modified A site can be represented by the formula $Y_{3-x}M_xB_5O_{15}$ ($0<x<3$) where M can be a rare earth element other than A or another 3+ cation (Ga, Sc). The modified B site can be represented by the formula $Y_3Al_{5-x}M_xO_{15}$ ($0<x<5$) where M can be 3+ cation (Ga, Sc). In another embodiment the substitution of aluminum with iron has the advantage of iron hopping from $Fe^{2+}$ to $Fe^{3+}$, thus partly occupying the octahedral or tetrahedral sites. This can be represented by $Y_3Al_{5-x}Fe_xO_{15}$ (0<x<2). Another embodiment is partially substituting $Al^{3+}$ sites with 2+ cations ($Mn^{2+}$) or 4+ cations ($Ti^{4+}$). This remarkably increases the ionic conductivity of the material. This can be represented by $Y_3Al_{5-x}M_xO_{15}$ (0<x<2) where M is Mn or Ti.

Spinel ceramic materials generally offer a desirable combination of properties for use in high temperature applications. Magnesium aluminate spinel ($MgAl_2O_4$) in particular is considered for thermal barrier coating applications due to its high melting temperature (2135° C.), good chemical stability and mechanical strength. This material has also been widely studied as a catalyst support for catalytic steam reforming of methane due to its low acidity and sintering-resistance ability. The present inventors have found that the catalytic activity of this material can be altered through ionic substitution/doping to meet low light-off/high conversion requirements for gas turbine combustor applications. Spinels have a general composition $AB_2O_4$, where A is a site with either tetrahedral (normal spinel) coordination or octahedral/tetrahedral (inverse spinel) coordination, and B is a site with octahedral coordination. Through the substitution of A and B sites with other cations, compositions are possible with improved thermal stability and catalytic activity, such as by partially substituting partial $Al^{3+}$ sites with 2+ cations ($Mn^{2+}$) or 4+ cations ($Ti^{4+}$). This remarkably increases the ionic conductivity of the material and can be represented by $MgAl_{2-x}M_xO_{15}$ (0<x<1) where M is Mn or Ti.

The addition of precious metal crystallites is desired when a two-stage catalyst can be realized in a single stage where the coating on the substrate exhibits enough catalytic activity to satisfy requirements in terms of light-off, conversion and performance. Precious metal crystallites may be incorporated within the crystal structure to allow the ceramic thermal barrier coating material to catalytically react a fuel-air mixture at a lower light-off temperature than would the ceramic thermal barrier coating material without the precious metal crystallites. The precious metal may be incorporated through incipient wetting, where the coating is dipped into precious metal salt to achieve desired loading, or through co-spraying with the ceramic coatings. A precious metal loading of 3-30 mg/in$^2$ may be desired to meet the catalyst requirements for gas turbine engine applications.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A catalyst element for a gas turbine engine comprising:

a metal substrate;

an outer layer of ceramic thermal barrier coating material disposed over the metal substrate, the ceramic thermal barrier coating material effective to thermally insulate the metal substrate from a high temperature fuel/air mixture; and the ceramic thermal barrier coating material comprising a base compound comprising a crystal structure populated with base elements and further comprising selected sites of the crystal structure being populated by substitute ions selected to allow the ceramic thermal barrier coating material to catalytically react the fuel-air mixture at a higher rate than would the base compound without the ionic substitutions wherein the ceramic thermal barrier coating material comprises a structure selected from the group consisting of:

a pyrochlore structure represented by the formula $A_{2-x}M_xB_2O_7$ (0<x<1), where A is a 3+ cation, B is a 4+ cation, and where M is any 3+ rare earth element other than A or 3+ cation smaller than A;

a pyrochlore structure represented by the formula $A_{2-x}M_xB_2O_7$ (0<x<1), where A is a 3+ cation, B is a 4+ cation, and where M is a 2+ cation selected the group consisting of Ca, Mg, Sr, and Ba;

a pyrochlore structure represented by the formula $A_2B_{2-x}M_xO_7$ (0<x<1), where A is a 3+ cation, B is a 4+ cation, and where M is Al or Sc;

a pyrochlore structure represented by the formula $A_2B_{2-x}M_xO_7$ (0<x<1), where A is a 3+ cation, B is a 4+ cation, and where M is Ta or Nb;

a garnet structure represented by the formula $Y_{3-x}M_xB_5O_{15}$ (0<x<3), where B is a 3+ cation, and where M is a rare earth element other than A;

a garnet structure represented by the formula $Y_{3-x}M_xB_5O_{15}$ (0<x<3), where B is a 3+ cation, and where M is Ga or Sc;

a garnet structure represented by the formula $Y_3Al_{5-x}M_xO_{15}$ (0<x<5), where M is Ga or Sc;

a garnet structure represented by $Y_3Al_{5-x}Fe_xO_{15}$ (0<x<2);

a garnet structure represented by $Y_3Al_{5-x}M_xO_{15}$ (0<x<2), where M is Mn or Ti; and a spinel structure represented by $MgAl_{2-x}M_xO_{15}$ (0<x<1), where M is Mn or Ti.

2. The catalyst element of claim 1, wherein the ceramic thermal barrier coating material further comprises a pyrochlore structure represented by the formula $Y_2O_3$—$ZrO_2$—$TiO_2$.

3. The catalyst element of claim 1, wherein the ceramic thermal barrier coating material comprises the pyrochlore structure represented by the formula $A_{2-x}M_xB_2O_7$ (0<x<1), where A is a 3+ cation, B is a 4+ cation, and where M is any 3+ rare earth element other than A or 3+ cation smaller than A.

4. The catalyst element of claim 1, wherein the ceramic thermal barrier coating material comprises the pyrochlore structure represented by the formula $A_{2-x}M_xB_2O_7$ (0<x<1), where A is a 3+ cation, B is a 4+ cation, and where M is a 2+ cation selected from the group consisting of Ca, Mg, Sr, and Ba.

5. The catalyst element of claim 1, wherein the ceramic thermal barrier coating material comprises the pyrochlore structure represented by the formula $A_2B_{2-x}M_xO_7$ (0<x<1), where A is a 3+ cation, B is a 4+ cation, and where M is Al or Sc.

6. The catalyst element of claim 1, wherein the ceramic thermal barrier coating material comprises the pyrochlore structure represented by the formula $A_2B_{2-x}M_xO_7$ (0<x<1), where A is a 3+ cation, B is a 4+ cation, and where M is Ta or Nb.

7. The catalyst element of claim 1, wherein the ceramic thermal barrier coating material comprises the garnet structure represented by the formula $Y_{3-x}M_xB_5O_{15}$ (0<x<3), where B is a 3+ cation, and where M is a rare earth element other than A.

8. The catalyst element of claim 1, wherein the ceramic thermal barrier coating material comprises the garnet structure represented by the formula $Y_{3-x}M_xB_5O_{15}$ (0<x<3), where B is a 3+ cation, and where M is Ga or Sc.

9. The catalyst element of claim 1, wherein the ceramic thermal barrier coating material comprises the garnet structure represented by the formula $Y_3Al_{5-x}M_xO_{15}$ (0<x<5), where M is Ga or Sc.

10. The catalyst element of claim 1, wherein the ceramic thermal barrier coating material comprises the garnet structure represented by $Y_3Al_{5-x}Fe_xO_{15}$ (0<x<2).

11. The catalyst element of claim 1, wherein the ceramic thermal barrier coating material comprises the garnet structure represented by $Y_3Al_{5-x}M_xO_{15}$ (0<x<2) where M is Mn or Ti.

12. The catalyst element of claim 1, wherein the ceramic thermal barrier coating material comprises the spinel structure represented by $MgAl_{2-x}M_xO_{15}$ (0<x<1) where M is Mn or Ti.

13. The catalyst element of claim 1, further comprising precious metal crystallites disposed within the crystal structure to a loading of 3-30 mg/in$^2$ and effective to allow the ceramic thermal barrier coating material to catalytically react the fuel-air mixture at a lower light-off temperature than would the ceramic thermal barrier coating material without the precious metal crystallites.

14. The catalyst element of claim 1, wherein the ceramic thermal barrier coating material is deposited by a plasma spray process with a layered structure exhibiting an effective SSA value of greater than 30 m$^2$/g.

15. The catalyst element of claim 1, wherein the ceramic thermal barrier coating material is deposited by a vapor deposition process to achieve a columnar grained structure exhibiting an SSA value of greater than 30 m$^2$/g.

16. The catalyst element of claim 15, further comprising the columnar grained structure exhibiting an SSA value of between 50-150 m$^2$/g.

17. The catalyst element of claim 15, further comprising the columnar grained structure exhibiting an SSA value of between 100-150 m$^2$/g.

* * * * *